US010138680B2

(12) United States Patent
Williams et al.

(10) Patent No.: US 10,138,680 B2
(45) Date of Patent: Nov. 27, 2018

(54) HINGED TRAY FOR LADDER OR STEP STOOL

(71) Applicant: Tricam Industries, Inc., Eden Prairie, MN (US)

(72) Inventors: Benjamin P. Williams, Chaska, MN (US); Joseph P. Foley, St. Paul, MN (US); Dennis D. Simpson, Plymouth, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 110 days.

(21) Appl. No.: 14/971,200

(22) Filed: Dec. 16, 2015

(65) Prior Publication Data

US 2016/0348434 A1 Dec. 1, 2016

Related U.S. Application Data

(60) Provisional application No. 62/166,462, filed on May 26, 2015.

(51) Int. Cl.

| | |
|---|---|
| ***E06C 7/00*** | (2006.01) |
| ***E06C 7/14*** | (2006.01) |
| ***E06C 1/387*** | (2006.01) |

(52) U.S. Cl.

CPC ..... *E06C 7/14* (2013.01); *E06C 1/387* (2013.01)

(58) Field of Classification Search

CPC ..... E06C 7/14; E06C 1/08; E06C 1/12; E06C 1/14; E06C 1/16; E06C 1/383; E06C 1/3835; E06C 1/39; E06C 1/393; E06C 7/00; E06C 7/16; E06C 7/182; E06C 7/50; B25H 3/06; B25H 3/02

USPC ..... 182/129; 248/238

See application file for complete search history.

(56) References Cited

U.S. PATENT DOCUMENTS

| | | | | | |
|---|---|---|---|---|---|
| 2,865,546 | A | * | 12/1958 | Shull | E06C 7/14 182/125 |
| 2,957,542 | A | * | 10/1960 | Rizzuto | E06C 7/182 182/106 |
| 3,625,388 | A | | 12/1971 | Golden et al. | |
| 3,744,591 | A | | 7/1973 | Lucci et al. | |
| 4,502,564 | A | | 3/1985 | Kümmerlin et al. | |
| 4,936,463 | A | * | 6/1990 | Tiramani | A45C 5/005 132/315 |
| 4,979,590 | A | * | 12/1990 | Bailey | E06C 7/14 182/106 |
| 5,052,581 | A | | 10/1991 | Christ et al. | |
| 5,573,081 | A | * | 11/1996 | Bartnicki | E06C 7/14 182/129 |
| 5,613,574 | A | | 3/1997 | Melanson | |
| 5,673,885 | A | | 10/1997 | Pham | |
| 5,722,507 | A | * | 3/1998 | Kain | E06C 1/393 182/104 |

(Continued)

*Primary Examiner* — Daniel P Cahn

(74) *Attorney, Agent, or Firm* — Patterson Thuente Pedersen, P.A.

(57) ABSTRACT

A hinged tray for a ladder or step stool disclosed. The hinged tray includes compartments for holding tools or hardware while the tray is open or closed. The footprint of the top of the ladder or step stool top cap is the same as the footprint of the hinged tray so that when the hinged tray is in the folded position the two footprints are aligned and the front and rear surfaces of the top cap and tray are at the same angle as the rails of the ladder or step stool.

6 Claims, 10 Drawing Sheets

(56) References Cited

U.S. PATENT DOCUMENTS 5,740,883 A * 4/1998 Trank ..... E06C 7/14 182/129
5,873,433 A * 2/1999 Katz ..... E06C 7/14 182/129
5,913,380 A * 6/1999 Gugel ..... B25H 3/023 182/129
6,443,260 B1 * 9/2002 Katz ..... B25H 3/06 182/129
6,467,577 B1 * 10/2002 Charlebois, Jr. ..... E06C 7/14 182/121
6,902,034 B2 * 6/2005 Gibson ..... E04G 1/28 182/129
7,000,732 B1 * 2/2006 Briggs, Jr. ..... B25H 3/00 182/129
7,032,711 B1 * 4/2006 Katz ..... B25H 3/06 182/129
7,108,103 B2 * 9/2006 Meeker ..... E06C 1/393 182/165
7,370,726 B1 * 5/2008 Chavez ..... E06C 1/18 182/129
7,967,111 B2 * 6/2011 Meyers ..... E06C 1/387 182/129
D642,283 S * 7/2011 Eriksson ..... D25/66
8,186,481 B2 * 5/2012 Moss ..... E06C 1/18 182/129
8,596,454 B1 * 12/2013 Carlson ..... B25H 3/06 182/129
9,309,718 B1 * 4/2016 Matthew ..... E06C 1/18
2002/0104709 A1 * 8/2002 Hines ..... B25H 3/006 182/129
2003/0029676 A1 * 2/2003 Gibson ..... E06C 1/393 182/161
2006/0006024 A1 * 1/2006 Till ..... E06C 1/39 182/129
2007/0120028 A1 * 5/2007 Kane ..... E06C 7/14 248/210
2009/0272602 A1 * 11/2009 Kocher ..... E04G 5/00 182/129
2010/0224445 A1 * 9/2010 Moss ..... E06C 1/387 182/129
2012/0211305 A1 * 8/2012 Moss ..... E06C 1/22 182/106
2012/0228059 A1 * 9/2012 Lampe ..... E06C 7/14 182/129
2013/0270037 A1 * 10/2013 Pensieri ..... E06C 7/16 182/107
2015/0014094 A1 * 1/2015 Brooks ..... E06C 7/14 182/129
2015/0090533 A1 * 4/2015 Moss ..... E06C 1/16 182/180.1
2016/0024845 A1 * 1/2016 Coe ..... E06C 7/14 220/737
2016/0038789 A1 * 2/2016 Cheyne ..... E06C 1/381 182/36
2016/0177626 A1 * 6/2016 Miller ..... E06C 7/14 396/419

* cited by examiner

FIG. 4
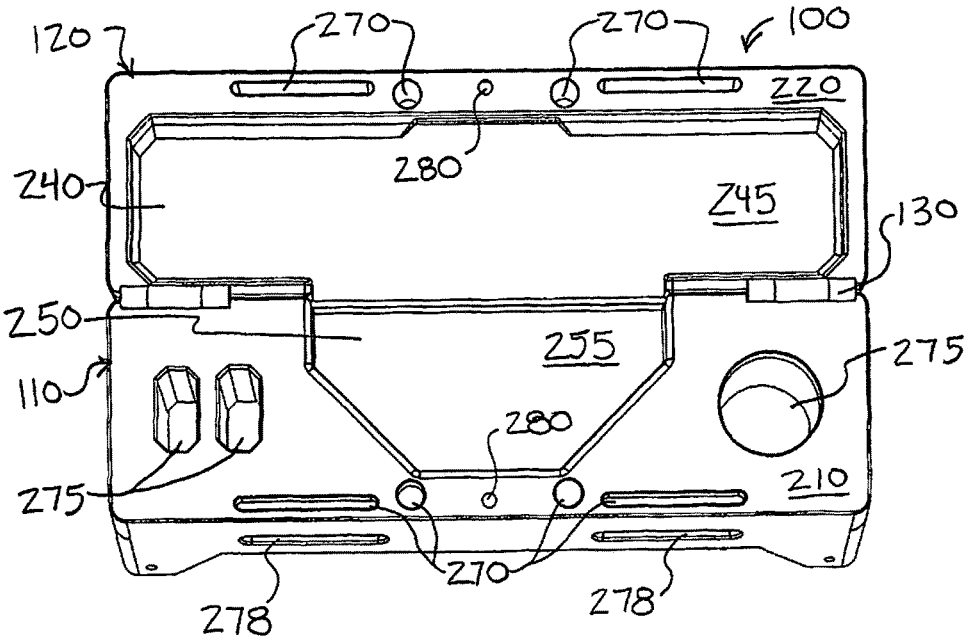
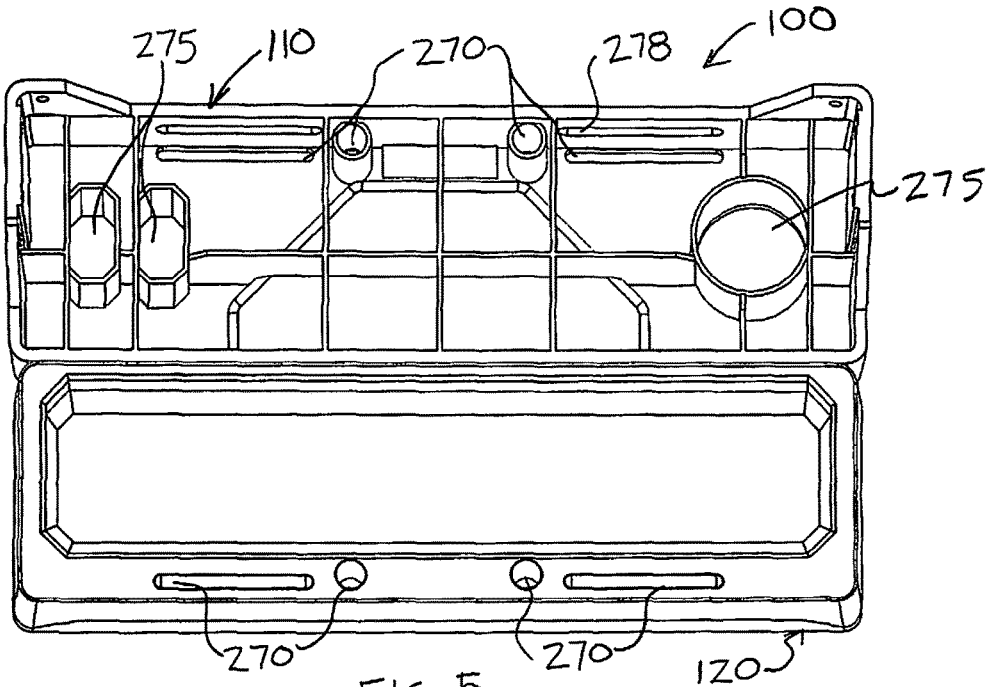
FIG. 5

HINGED TRAY FOR LADDER OR STEP STOOL

RELATED APPLICATIONS

This application claims the benefit of U.S. Provisional Application No. 62/166,462, filed May 26, 2015, entitled "Hinged Tray for Ladder or Step Stool," which is hereby fully incorporated herein by reference.

FIELD OF THE INVENTION

The present invention relates to a folding tray for a ladder or step stool which also acts as the top cap of the ladder or step stool to hold tools and hardware while the tray is open or closed.

BACKGROUND OF THE INVENTION

Ladders and step stools are generally known in the art. Kummerlin, U.S. Pat. No. 4,502,564, discloses a foldable step ladder. Because of their desired portability, foldable step ladders often include handles and other features that make them easier to transport. Lucci, U.S. Pat. No. 3,744,591, discloses a portable, folding step ladder.

When working on a ladders or step stool, it is often desirable to have tools, paint, and other necessary objects within easy reach. For example, it is known to removably attach a paint roller tray to the rung of a ladder to more easily paint a ceiling or other area requiring a ladder or step stool. Golden, U.S. Pat. No. 3,625,388, discloses a paint tray particularly useful with an upright ladder.

Utility trays for use with ladders and step stools are also known in the art. Pham, U.S. Pat. No. 5,673,885, discloses a paint tray for a step ladder for storing work materials, tools and a paint bucket that is held onto the ladder by retaining means. Melanson, U.S. Pat. No. 5,613,574, discloses a ladder mounted tool holster and parts tray that removably clamps onto the top step of a step ladder. Katz et al., U.S. Pat. No. 6,443,260, discloses a step ladder tray pivotally attached to the top cap of a step ladder for supporting tools and the like. Christ et al., U.S. Pat. No. 5,052,581, discloses a detachable ladder support tray for supporting tools and paint containers.

It is often inconvenient, however, to use a removable tool or paint tray with a ladder or step stool. In some instances, the tray may be difficult to attach or remove from the ladder or step stool depending on the configuration of the top cap of the ladder or step stool. The removable tray and ladder or step stool usually must be stored separately, taking up additional space. Additionally, to move a ladder or step stool from place to place, the tray may need to be removed and carried separately because of weight or awkward transport configuration.

There is a need in the industry to have hinged tray that is integrated into ladders and step stools to hold tools and hardware, but does not increase the footprint of the top of the ladder or step stool.

SUMMARY OF THE INVENTION

In embodiments, a hinged tray for ladders and step stools is disclosed. The hinged tray allows for a larger work area on the top of a ladder or step stool while the hinged tray folds to fit within the footprint of the top cap of the ladder or step stool. The hinged tray provides a more secure work area as half the work area comprises the top cap of the ladder or step stool. The hinged tray can still be used as work area for holding tools and hardware when the hinged tray is folded. The hinged tray includes indents that can be used as a handle for carrying the ladder or step stool when in the folded position. The hinged tray can be manufactured of any formable durable material such as metal or plastic, but the preferred embodiment is plastic. The hinged tray can be attached to the ladder or step stool by any means known in the art, but the preferred embodiment is by rivets. The hinged tray includes various compartments and cut-outs that allow various tools and hardware to be stored upon the tray while in use. The invention includes means of keeping the folded tray in the closed position when the ladder or step stool is in a stored position.

It is an object of the invention to provide a hinged tray for the top of ladders and step stools. It is also an object of the invention to provide a hinged tray that is integral to the structure of the ladder or step stool. It is another object of the invention to provide a hinged tray that does not increase the footprint of the ladder or step stool to eliminate any impact on storing of the ladder or step stool from the tray. It is a further object of the invention to provide access to the tray at the top of the ladder or step stool without having to reach over and beyond the top of the ladder or step stool. It is another object of the invention to provide a tray for which the depth of tray for the top of ladders and step stools that is not constrained by the distance between the platforms or rungs of the ladders and step stool.

BRIEF DESCRIPTION OF THE DRAWINGS

The invention may be more completely understood in consideration of the following detailed description of various embodiments of the invention in connection with the accompanying drawings, in which:

FIG. 4 is a top view of an embodiment the hinged tray of the step stool in FIG. 1 in the open position.

FIG. 5 is a bottom view of an embodiment the hinged tray of the step stool in FIG. 1 in the open position.

Figure 1:
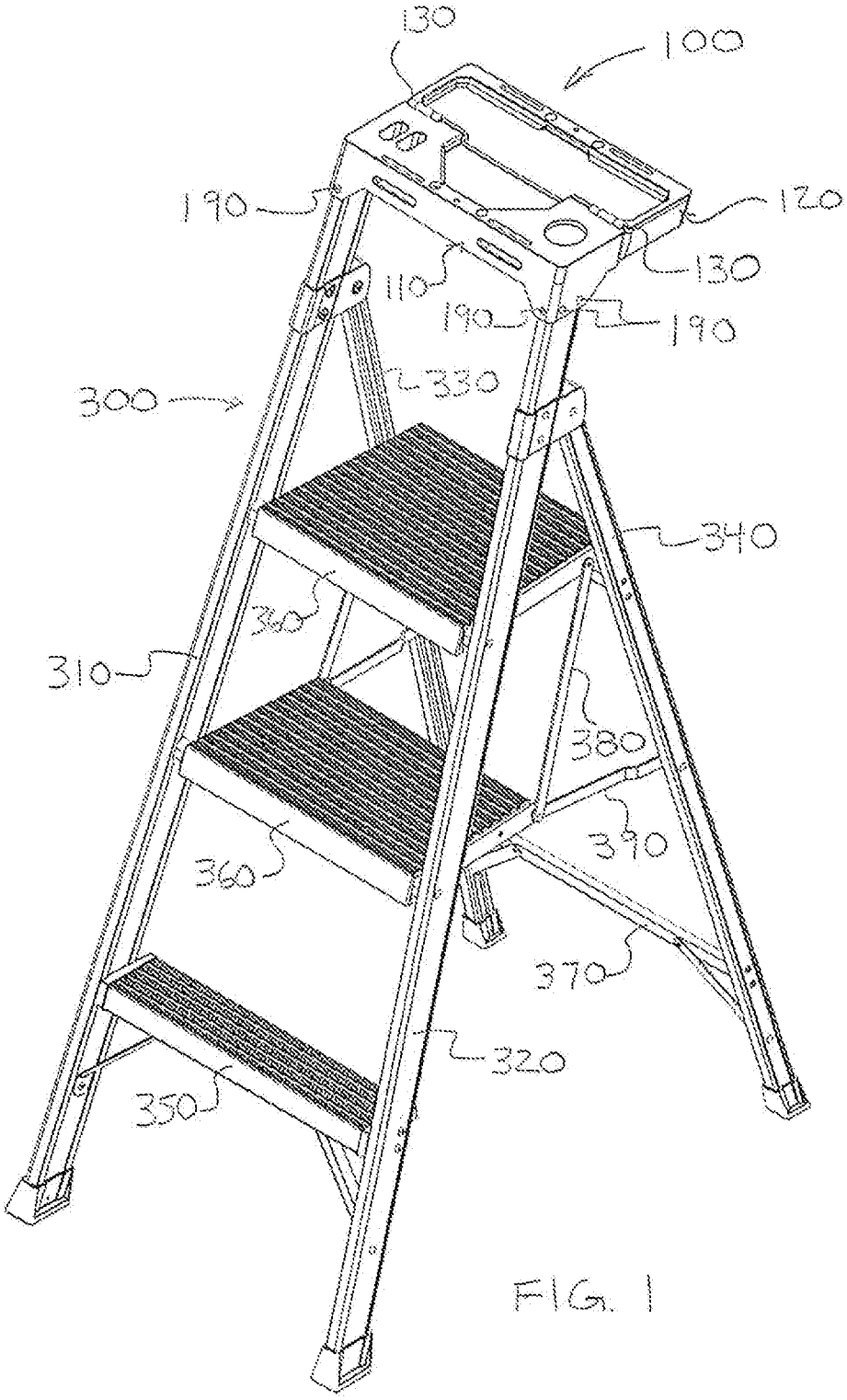
FIG. 1 is an isometric view of a step stool incorporating an embodiment of the invention.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION OF THE DRAWINGS

Attached are drawings of an embodiment of the hinged tray of the present invention as well as detailed drawings of the individual components of the hinged tray. It is understood that the various components disclosed in the drawings may be substituted with equivalent components and are not considered limiting.

The following detailed description should be read with reference to the drawings in which similar elements in different drawings are numbered the same. The accompanying Figures depict embodiments of the hinged tray of the present invention, and features and components thereof. Any references to front and back, right and left, top and bottom, upper and lower, and horizontal and vertical are intended for convenience of description, not to limit the present invention or its components to any one positional or spatial orientation. The drawings, which are not necessarily to scale, depict illustrative embodiments and are also not intended to limit the scope of the invention. Any reference in the claims to a "ladder" is not intended to limit the scope of the invention to a specific type of ladder, but to any type of ladder including ladders, step ladders, step stools, podium ladders, etc.

Referring generally to the Figures, embodiments of the present invention include a hinged tray 100 having a top cap portion 110 and a folding portion 120, connected via at least one hinge 130. The hinge can be a conventional hinge (as shown in FIGS. 1 and 4) or may be any other mechanism known in the art to allow the top cap portion 110 and folding portion 120 to pivot with respect to each other, such as a living hinge, a strap hinge, or an integral molded hinge.

The hinged tray 100 is secured to at least a front left rail 310 and a front right rail 320 of a step ladder 300. In the embodiment shown in FIGS. 1-12, the hinged tray 100 is secured to a step ladder 300. The hinged tray of this embodiment is secured to the front left rail 310 and front right rail 320 by rivets 190. However, the hinged tray may be secured to the ladder via any other mechanisms known in the art, such as screws or bolts. In the embodiment of FIGS. 1-12, the step ladder has at least one platform 360 and one rung 350 connected to the front left rail 310 and front right rail 320. Platforms 360 may be connected directly to the rear left rail 330 and right rear rail 340 or may be connected to the rear left rail 330 and right rear rail 340 via tie bars 380 or link bars 390. Cross members 370 connect the rear left rail 330 and right rear rail 340 to provide support and stiffening to the step ladder 300.

Another embodiment (not shown) contemplates that the hinged tray 100 can be secured to a conventionally configured ladder to the front left rail 310 and front right rail 320 as well as the rear left rail 330 and read right rail 340 to act as the top cap of the conventionally configured ladder. With a conventionally configured ladder, the steps would all consist of rungs 350 between the front left rail 310 and the front right rail 320 with cross member 370 between the rear left rail 330 and rear right rail 340.

Figure 2:
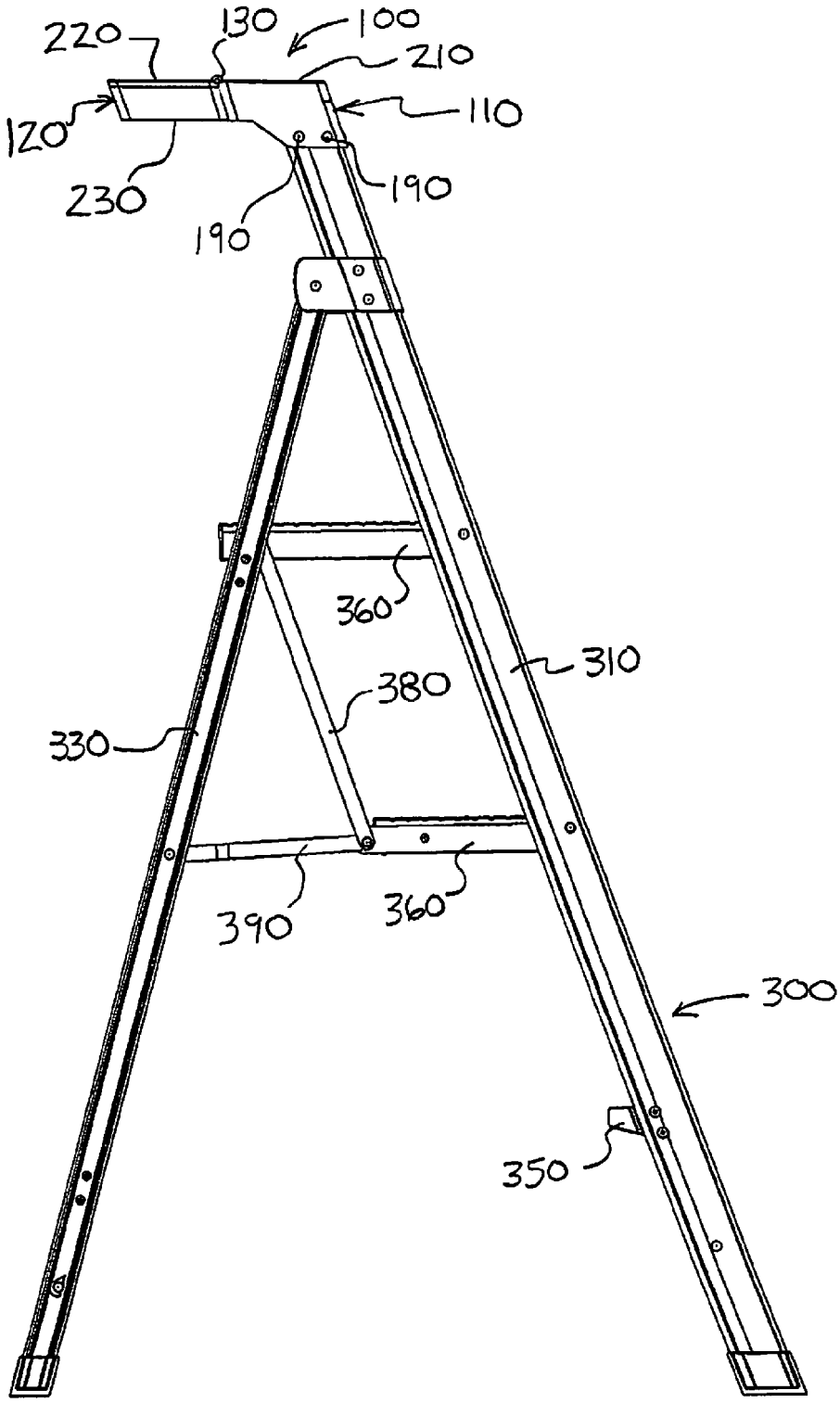
FIG. 2 is a left side elevation view of the step stool of FIG. 1.
Figure 3:
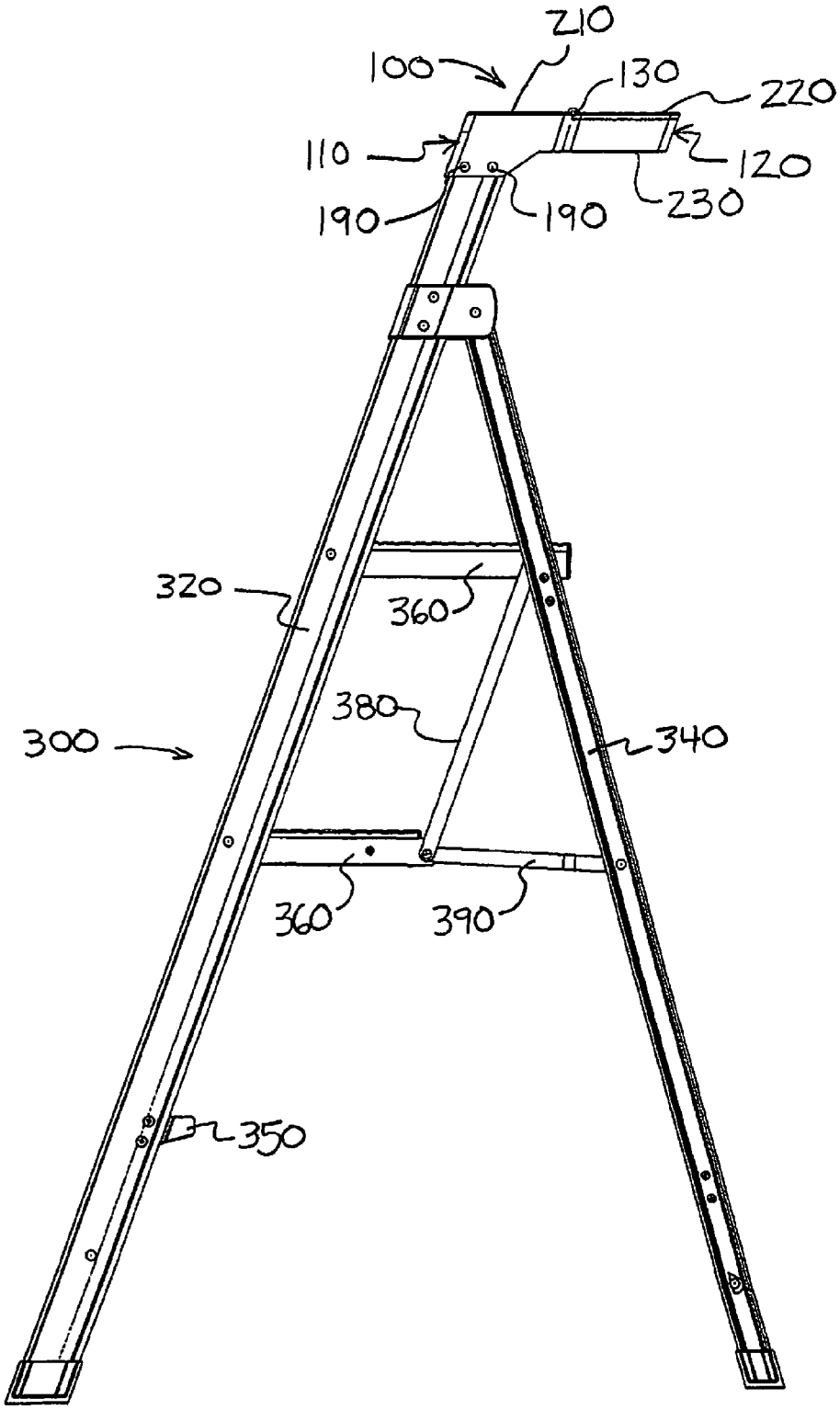
FIG. 3 is a right side elevation view of the step stool of FIG. 1.
Figure 6:
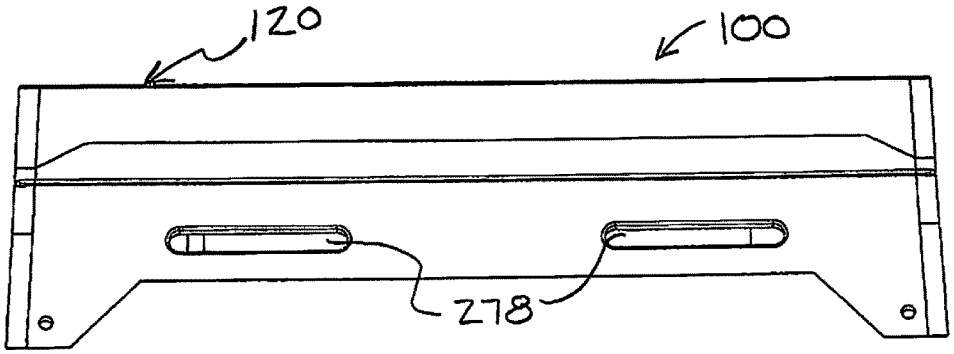
FIG. 6 is a front elevation view of an embodiment of the hinged tray of the step stool in FIG. 1 in the closed position.

As shown in FIGS. 2 and 4, the top cap portion top face 210 and the folding portion top face 220 of the hinged tray 100 are configured to be coplanar when the hinged tray 100 is in the open position. This allows the top cap portion top face 210 and folding portion top face 220 to abut each other in the closed position. It is not necessary that the top cap portion top face 210 and folding portion top face 220 lay completely flat against each other as long as the structures provide sufficient support when the hinged tray 100 is in the closed position. The footprint of the top cap portion top face 210 and folding portion top face 220 preferably have generally the same outside dimensions so that the outside edges of the top cap portion top face 210 and bottom portion top face are aligned when the hinged tray 100 is in the closed position.

Figure 7:
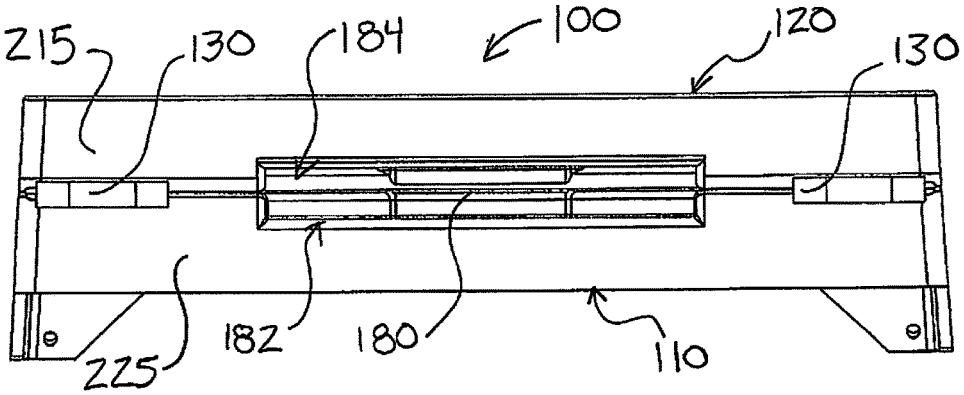
FIG. 7 is a rear elevation view of an embodiment of the hinged tray of the step stool in FIG. 1 in the closed position.
Figure 8:
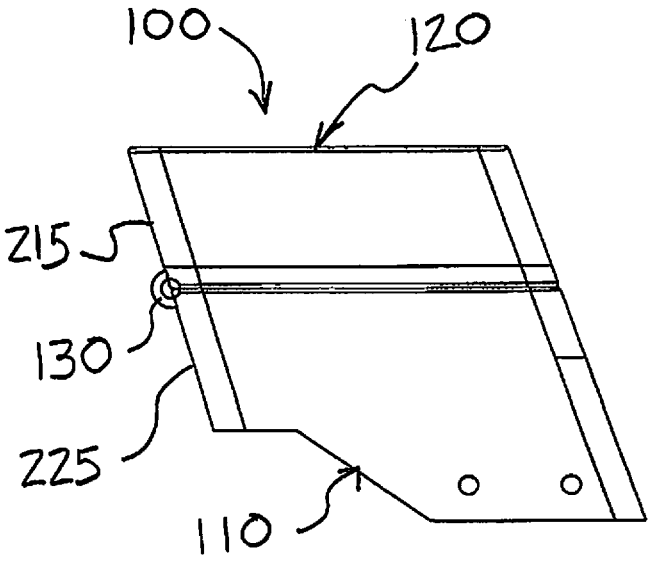
FIG. 8 is a left side elevation view of an embodiment of the hinged tray of the step stool in FIG. 1 in the closed position.
Figure 9:
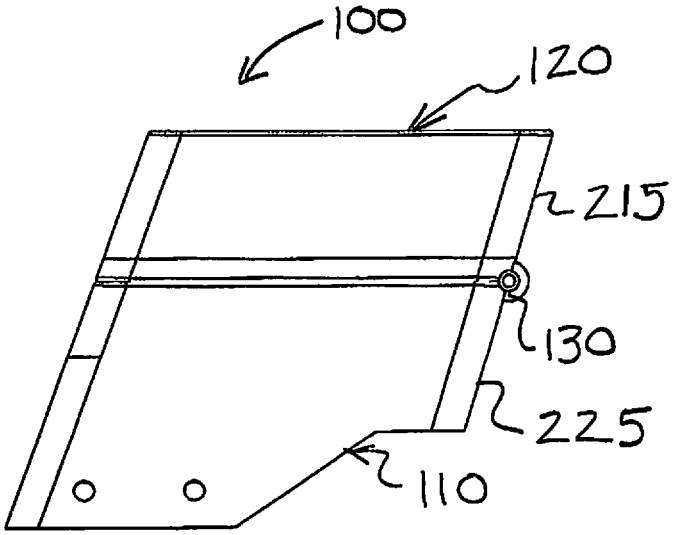
FIG. 9 is a right side elevation view of an embodiment of the hinged tray of the step stool in FIG. 1 in the closed position.

As can be seen in FIGS. 7-9, the top cap portion 110 has a rear face 215 and the folding portion 120 has a rear face 225. In a preferred embodiment, when the hinged tray is in closed position the top cap portion rear face 215 and the folding portion rear face 225 are coplanar. Further in this preferred embodiment, when the hinged tray is in the open position the top cap portion rear face 215 and the folding portion rear face 225 abut each other. This arrangement makes the hinged tray 100 the most robust for carrying weight from tools, hardware, and paint when in the open position.

As shown most clearly in FIG. 4, the hinged tray 100 includes a top cap portion top recess 240 and a folding portion top recess 250. These recesses 240, 250 form areas for receiving and holding tools or hardware. When configured to form a single continuous area (such as the embodiment shown in FIG. 4), the recesses define an area for receiving and stabilizing containers such as paint cans. To provide stability to items placed on the hinged tray 100 while in the open position, the top cap portion top recess 240 has a face 245 and the folding portion top recess 250 has a face 255 which is are coplanar.

Another benefit of this embodiment is that the adjoining portions of the top cap portion top recess 240 and a folding portion top recess 250 form a top cap portion indent 182 and folding portion indent 184 when the hinged tray 100 is in the closed position (as shown in FIG. 7). These combined indents 182, 184 form a handle 180 to act as a handhold for carrying or transporting the step ladder 300.

Figure 10:
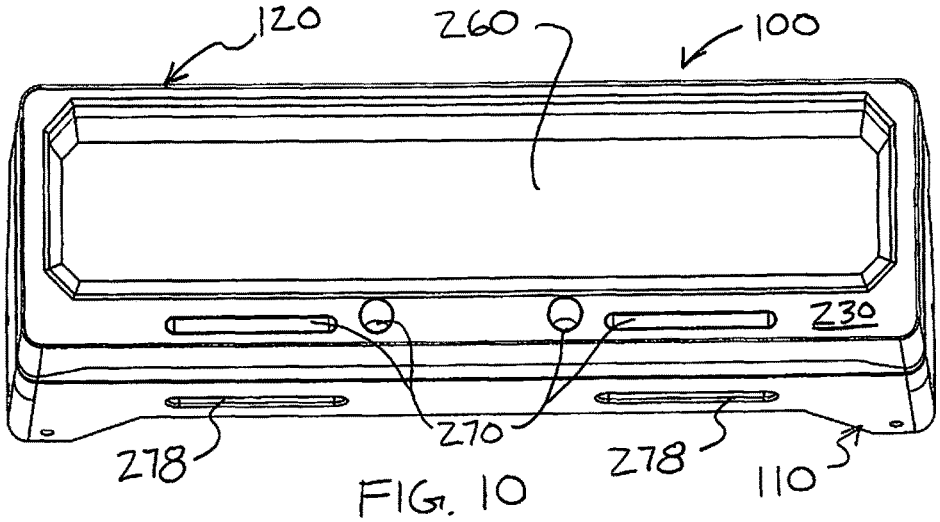
FIG. 10 is a top view of an embodiment the hinged tray of the step stool in FIG. 1 in the closed position.
Figure 11:
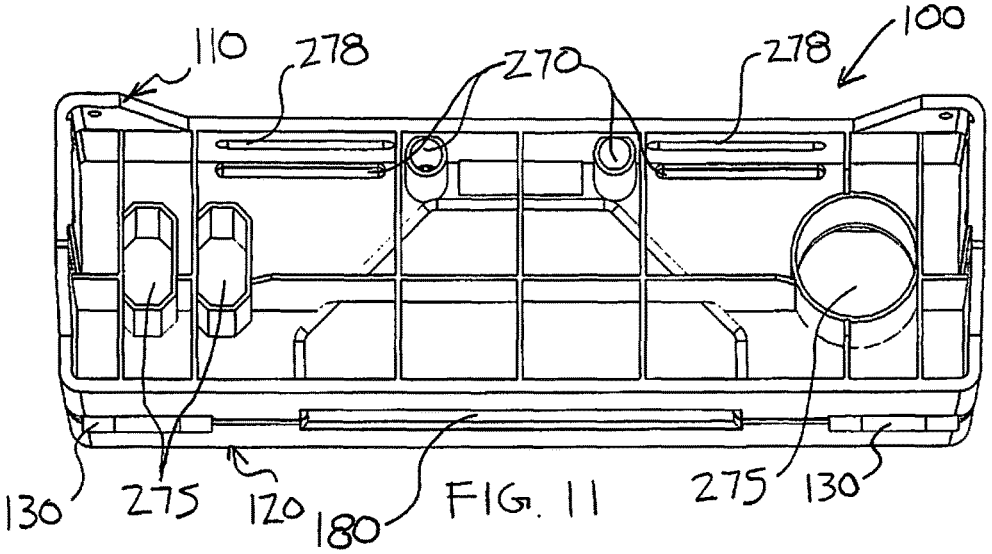
FIG. 11 is a bottom view of an embodiment the hinged tray of the step stool in FIG. 1 in the closed position.
Figure 12:
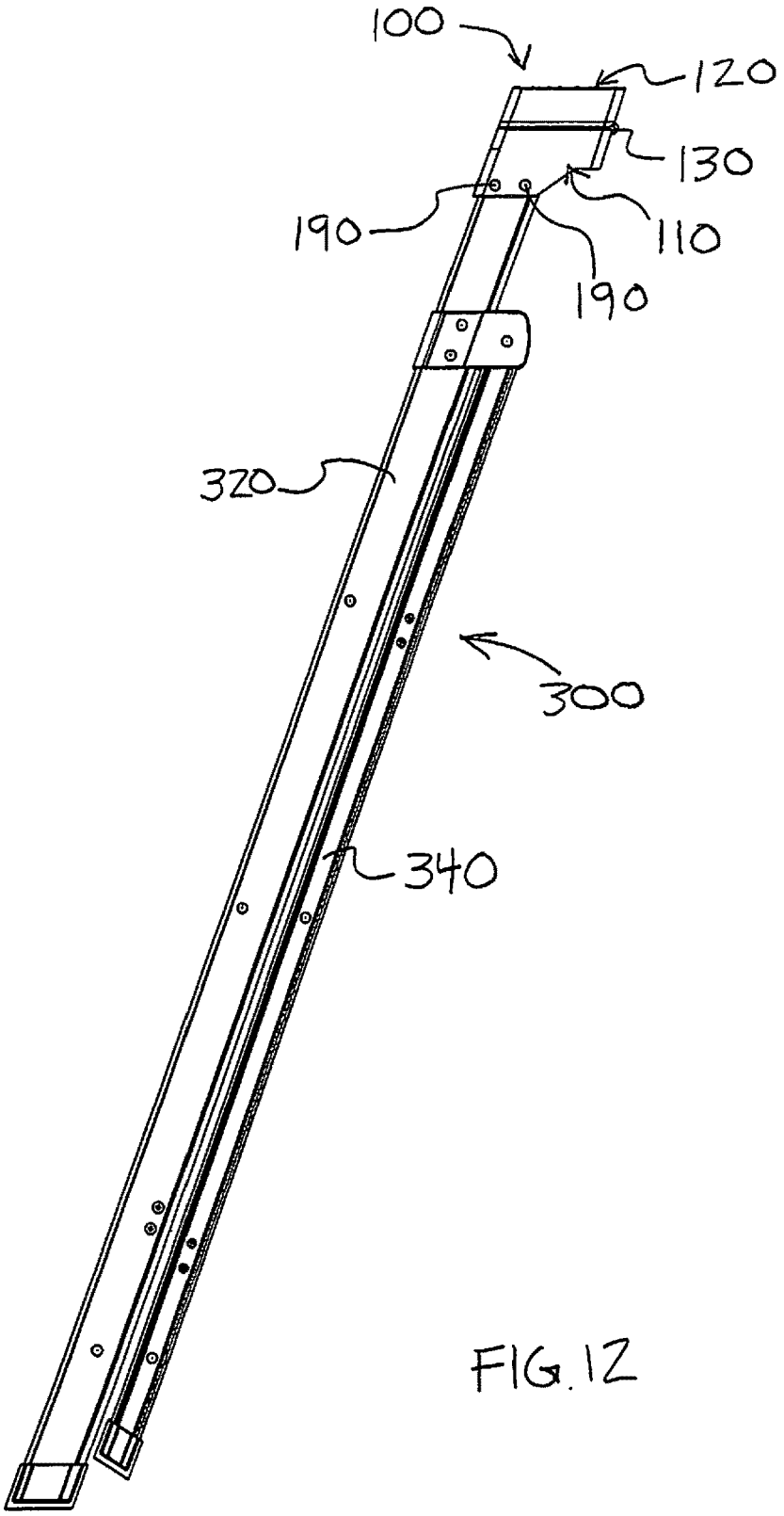
FIG. 12 is a right side elevation view of the step stool in FIG. 1 in the folded position with the hinged tray in a closed position.

As shown in FIG. 10, the folding portion 120 may also include a folding portion bottom recess 260. As with the top cap portion top recess 240 and folding portion top recess 250, the folding portion bottom recess 260 defines an area for receiving and holding tools or hardware when the hinged tray 100 is in the folded position.

Figure 13:
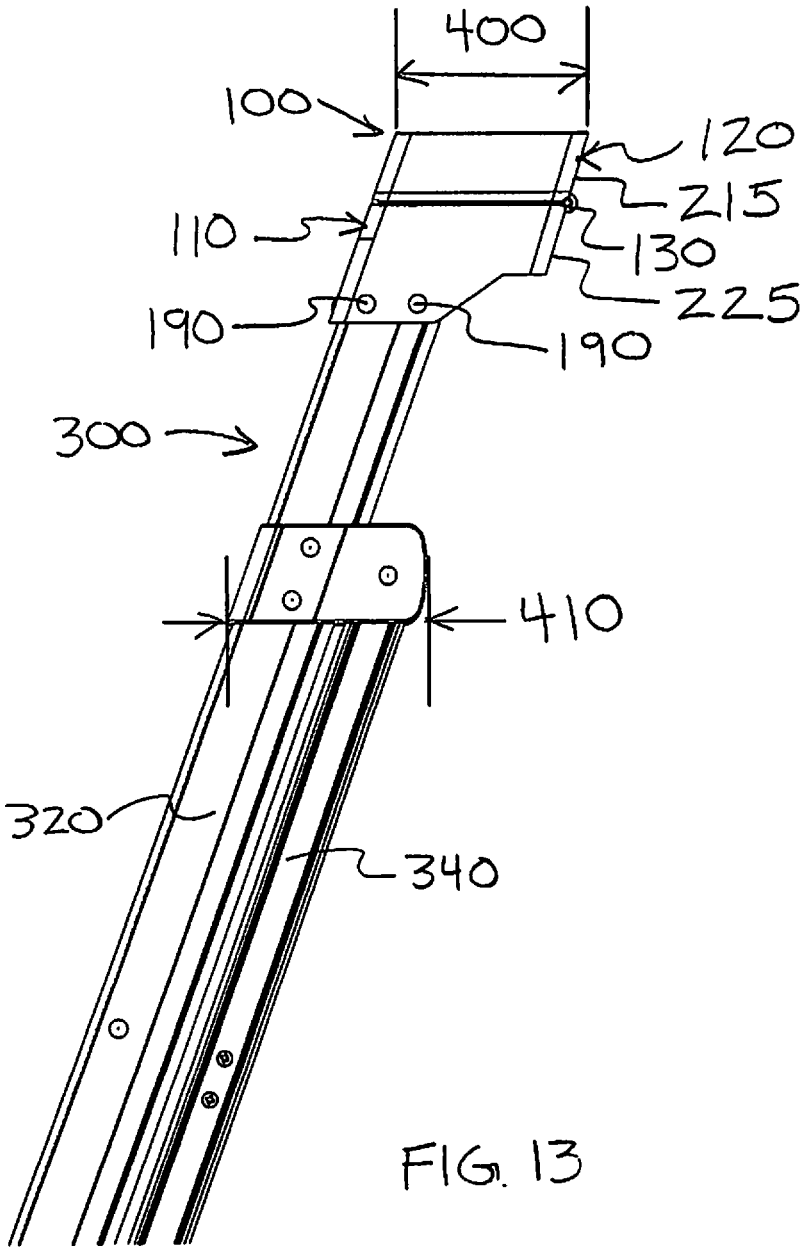
FIG. 13 is a more detailed right side elevation view of the step stool in FIG. 1 in the folded position with the hinged tray in a closed position.

A further feature of an embodiment of the invention is the width of the hinged tray 100 when in the folded position is no wider that the combined width of a front rail 310 or 320 and rear rail 330 or 340. As shown best by FIG. 13, the width of the hinged tray when in a closed position 400 is the same as the width of the step stool 300 when it is folded 410. This feature is beneficial because it does not make the step ladder 300 any wider for purposed of storing or transporting the step ladder 300, yet allows the hinged tray 100, to be much wider than just the width of the step stool 300 when in it folded 410. This feature also addresses a limitation in the prior art of a tray being necessarily constricted in width to the distance between rungs 350 and platforms 360.

Another feature of the hinged tray 100 is a series of openings 270, 275 in the top cap portion 110 and a folding portion 120. These openings 270, 275 can be of any shape and can be used to hold hardware, tools, or other items while working on the step ladder 300. Some openings 275 are intended to be used only when the hinged tray 100 is in the open position. Other openings 270 are aligned between the top cap portion 110 and a folding portion 120 so that they may be used when the hinged tray 100 is in the closed position.

The hinged tray 100 includes means for keeping it in the closed position. In the embodiment shown in FIG. 4, the means of keeping the hinged tray 100 in the closed position is a set of magnets 280 that are aligned to abut one another when the hinged tray 100 is in the closed position. Other means of keeping the hinged tray in the closed position include a latch between the top cap portion 110 and a folding portion 120, friction fittings, or any other means known in the art.

Figure 14:
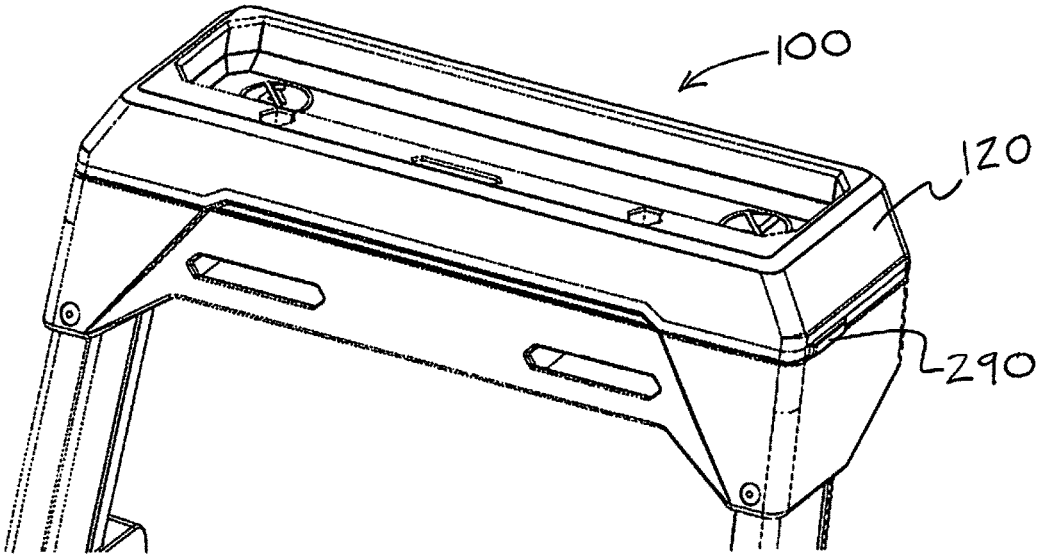
FIG. 14 is a detailed isometric view of another embodiment of the step stool of the present invention with the hinged tray in the closed position showing a thumb tab.

In another embodiment of the invention shown in FIG. 14, the hinged tray 100 may include thumb tabs 290 mounted to the folding portion 120 to provide an easier opening of the hinged tray 100 when in the closed position.

A variety of materials may be used to construct the various components of the invention. The hinged tray 100 and its components may be constructed from aluminum or other alloys that can be molded, but is preferable injection molded of strong and durable plastic materials representative of which are ABS, high-impact polystyrenes, and similar materials. Some components, such as rivets 190 and hinge 130 pins are preferably constructed of lightweight metal, such as aluminum. The above list of material selections should be considered exemplary and not in any way limiting and other suitable materials will be apparent to persons skilled in the art.

With regard to the above detailed description, like reference numerals used therein may refer to like elements that may have the same or similar dimensions, materials, and configurations. While particular forms of embodiments have been illustrated and described, it will be apparent that various modifications can be made without departing from the spirit and scope of the embodiments herein. Accordingly, it is not intended that the invention be limited by the forgoing detailed description.

Various modifications to the embodiments of the inventions may be apparent to one of skill in the art upon reading this disclosure. For example, persons of ordinary skill in the relevant art will recognize that the various features described for the different embodiments of the inventions can be suitably combined, un-combined, and re-combined with other features, alone, or in different combinations, within the spirit of the invention. Likewise, the various features described above should all be regarded as example embodiments, rather than limitations to the scope or spirit of the inventions. Therefore, the above is not contemplated to limit the scope of the present inventions.

Persons of ordinary skill in the relevant arts will recognize that the inventions may comprise fewer features than illustrated in any individual embodiment described above. The embodiments described herein are not meant to be an exhaustive presentation of the ways in which the various features of the inventions may be combined. Accordingly, the embodiments are not mutually exclusive combinations of features; rather, the inventions may comprise a combination of different individual features selected from different individual embodiments, as understood by persons of ordinary skill in the art.

We claim:

1. A ladder comprising:

a front rail;

a rear rail, wherein the rails are configured to pivot between a ladder open position and a ladder folded position;

a folded ladder depth defined by a first distance between a front surface of the front rail and a rear surface of the rear rail when said rails are in the ladder folded position;

a hinged tray configured to pivot between a hinged tray open position and a hinged tray closed position, the hinged tray comprising:

a top cap portion comprising:

a top cap surface platform having a top cap portion upper face and a top cap portion recess having a top cap portion recess face recessed from the top cap portion upper face, a top cap portion width, and a top cap portion rear face spaced a second distance from a top cap portion front face;

a folding portion comprising:

a folding surface platform having a folding portion upper face and a folding portion recess having a folding portion recess face recessed from the folding portion upper face, a folding portion width, and a folding portion rear face spaced the second distance from a folding portion front face;

a hinge connecting the top cap portion and the folding portion;

wherein the top cap portion rear face and the folding portion rear face abut when the folding portion is in the hinged tray open position;

wherein the top cap portion rear face and the folding portion rear face are coplanar when the folding portion is in the hinged tray closed position;

a hinged tray folded depth defined by the second distance when the hinged tray is in the hinged tray closed position;

wherein the hinged tray folded depth is not deeper than the folded ladder depth when the front rail and the rear rail are in the ladder folded position;

wherein the hinged tray is secured to at least one of the front rail or the rear rail;

wherein the folding portion upper face is generally coplanar with the top cap portion upper face when the hinged tray is in the hinged tray open position;

wherein the folding portion upper face abuts the top cap portion upper face when the hinged tray is in the hinged tray closed position;

wherein the top cap portion recessed face and the folding portion recessed face are generally and continuously coplanar along at least one third of the widths when the folding portion is in the hinged tray open position.

2. The ladder of claim 1, wherein the widths are substantially the same.

3. The ladder of claim 1 further comprising a magnet in one of the top cap portion or the folding portion.

4. The ladder of claim 2 further comprising an opening in the top cap surface platform of the top cap portion.

5. The ladder of claim 1 wherein the folding portion further comprises a thumb tab.

6. The ladder of claim 4 further comprising an opening in the folding surface platform being generally aligned with the opening in the top cap surface platform when the hinged tray is in the hinged tray closed position.

* * * * *